United States Patent [19]

Larsen et al.

[11] Patent Number: 4,547,673

[45] Date of Patent: Oct. 15, 1985

[54] SMOKE AND FLAME DETECTOR

[75] Inventors: Theodore E. Larsen, Edina; Michael P. Juaire, Chaska, both of Minn.

[73] Assignee: Detector Electronics Corporation, Minneapolis, Minn.

[21] Appl. No.: 456,615

[22] Filed: Jan. 10, 1983

[51] Int. Cl.[4] ..... H05B 33/00

[52] U.S. Cl. ..... 250/554; 250/573; 250/239

[58] Field of Search ..... 250/554, 573, 574, 239, 250/575, 252; 356/437, 438, 439, 440, 442; 340/578, 600, 630

[56] References Cited

U.S. PATENT DOCUMENTS

| | | | |
|---|---|---|---|
| 3,263,553 | 8/1966 | Baruch | 250/574 |
| 3,906,241 | 9/1975 | Thompson | 250/575 |
| 4,152,075 | 5/1979 | Rellstab et al. | 250/575 |
| 4,369,364 | 1/1983 | Kuntermann | 250/239 |
| 4,405,234 | 9/1983 | Juaire | 356/239 |

*Primary Examiner*—David C. Nelms

*Attorney, Agent, or Firm*—Paul L. Sjoquist

[57] ABSTRACT

Apparatus for detecting flame or smoke, having a radiation detection tube enclosed in a housing, facing the exterior through a transparent window at one end of the housing, and having a radiation source proximate the other end of the housing and external the tube housing, with an optical path exterior of the housing from the radiation source to a reflector ring positioned in front of the transparent window and in a direction to deflect radiation from the radiation source through the transparent window to the radiation detection tube. The invention also includes a second internal radiation source optically coupled to the radiation detection tube for providing a reference radiation, which not only provides a comparison base for radiation received by the radiation detection tube from external radiation sources, but also provides a monitor function to evaluate the quality of the optical path through the window and to check the operation of the radiation detection tube and related circuits.

6 Claims, 4 Drawing Figures

SMOKE AND FLAME DETECTOR

BACKGROUND OF THE INVENTION

The present invention relates to apparatus for detecting the presence of flame and/or smoke, or radiation absorbing vapors, utilizing a single radiation detection tube.

U.S. Pat. No. 3,952,196, issued Apr. 20, 1976 and owned by the assignee of the present invention, discloses a device for determining whether the optical surfaces through which radiation must travel from a hazardous area of radiation to the radiation detector are free from radiation-absorbing material or radiation-blocking material. The device disclosed in this patent includes an enclosure for commonly housing both an auxiliary light source and a radiation detector tube, while isolating the same from each other, preventing radiation transmission within the housing from the light source to the detector. The patent also discloses a radiation path from the light source outwardly from the housing to a reflective surface or surfaces external of the housing, which surfaces reflect at least some of the radiation back to the detector through the same optical surfaces that other external radiation passes. The patent contemplates external reflective surfaces which either form a part of the outside housing structure, or are remotely located therefrom.

U.S. patent application No. 289,813, filed Aug. 3, 1981, now U.S. Pat. No. 4,405,234 and owned by the assignee of the present invention, discloses a radiation detector tube enclosed in a housing having a light transparent window at one end thereof, with an auxiliary light source enclosed within the housing in optical isolation with respect to the radiation detection tube. The transparent window is constructed with a beveled edge surface and the auxiliary light source is positioned so as to radiate light through the beveled edge, a portion of which is reflected backwards from the interface surface of the front of the transparent window and back through the diametrically-opposite beveled edge of the transparent window. An internal mirrored surface is positioned to collect and reflect the light so received, and to direct the light radiation to the detection tube. The invention provides a self-checking feature for the radiation detection tube and the optical path to the radiation detection tube to the point of interface with the external environment, through a totally-enclosed construction.

SUMMARY OF THE INVENTION

The present invention provides a self-checking feature for the operation of a radiation detection tube, while at the same time providing, through an optical path external to the device, an apparatus for detecting smoke, and other optically-opaque or absorbing vapors. The radiation detection tube is enclosed within a housing which is optically sealed except for a window at one end thereof. A first internal radiation source emits light over an optical path through the window and is reflected by a surface outside the housing but adjacent the window, back to the radiation detection tube. A second radiation source is included within the housing, but emits light over an optical path external to the housing, which optical path extends from proximate the rear end of the housing to a region in front of the housing window. A reflective surface is positioned external to the housing and in front of the housing window so as to reflect light from the second radiation source back through the window and into the radiation detection tube. The radiation detection tube may also receive light from an externally-detected flame, and therefore serve as a flame detector, or it may receive reflected light from the second radiation source and therefore serve as a smoke monitor and detector, and may receive light from the first internal radiation source which may be used as a calibration base for the other sources of light as well as a self-checking feature for the operation of the apparatus.

It is a principal object of the present invention to provide a radiation detection device which functions both as a smoke detector and as an external radiation detector.

It is another object of the present invention to provide a radiation detection apparatus having a self-checking feature for monitoring the operation of the apparatus.

It is a further object of the present invention to provide a radiation and smoke detector having an internal light source for calibration and monitoring the apparatus, and a second light source for transmitting light over a predetermined external path for smoke or vapor detection.

These and other objects and advantages of the invention will become apparent from the following specification and drawings.

DESCRIPTION OF THE PREFERRED EMBODIMENT

Figure 1:
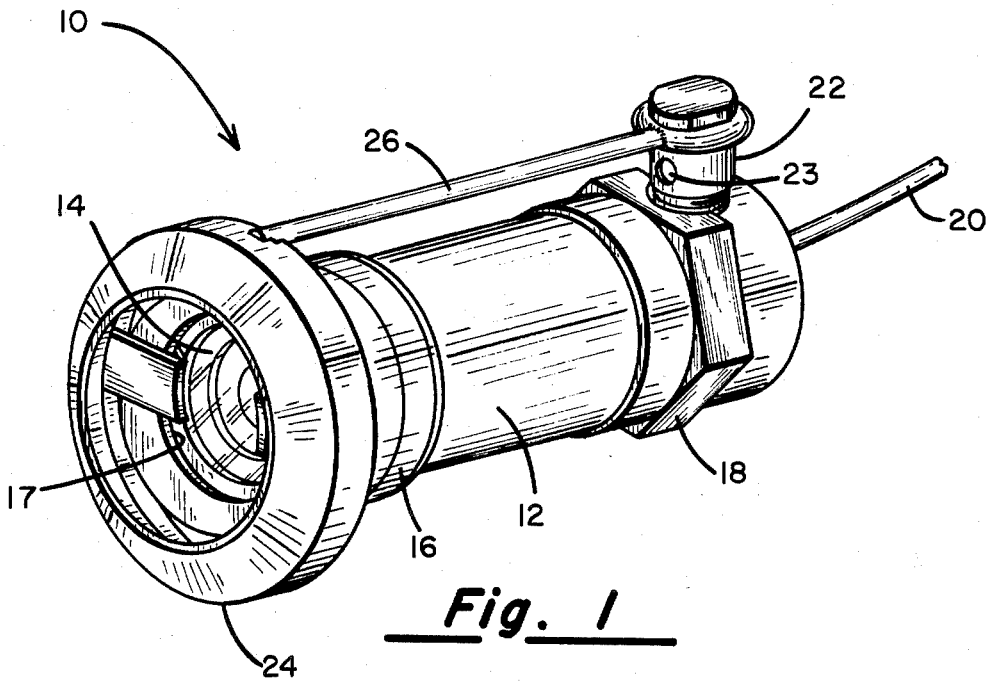
FIG. 1 shows the invention in isometric view.

Referring first to FIG. 1, the invention is shown in isometric view. A radiation and smoke detector 10 has a tubular housing 12 which is threadably attached at one of its ends to an end cap 18. Threadably attached to the other end of tubular housing 12 is a lens cap 16. Lens cap 16 contains a transparent lens or window 14 which is securely held therein. A removable ring 24 is attached at the front of lens cap 16 in a manner which will be hereinafter described. A cover 22 is attached threadably into end cap 18, and a positioning bar 26 extends between the ring 24 and cover 22. An electrical cable 20 extends through an opening in the rear of end cap 18, and cable 20 contains all of the electrical wires necessary for the operation of the apparatus.

Figure 2:
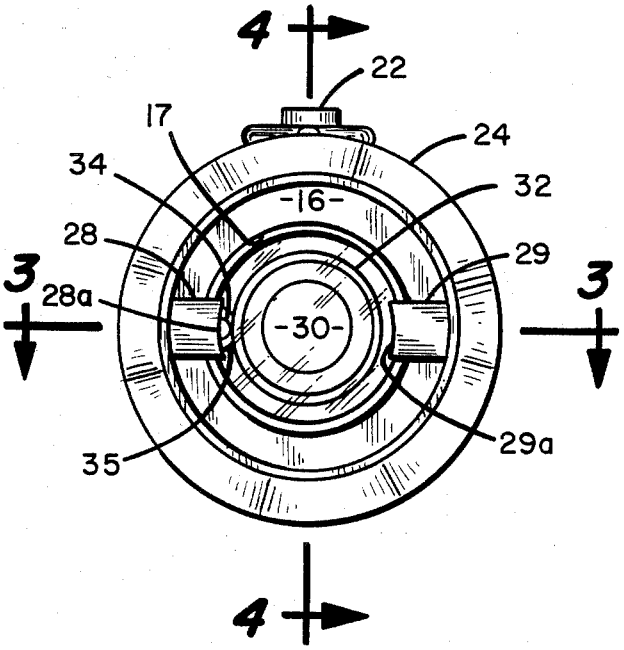
FIG. 2 shows a front end view.

FIG. 2 shows a front end view of the apparatus, illustrating a number of concentrically-aligned components. A radiation detector 30 is axially aligned with tubular housing 12, and a number of additional components to be hereinafter described are concentrically arranged about radiation detector 30. Radiation detector 30 may be an ultraviolet detection tube having a relatively high degree of sensitivity for detecting radiation in the range of 1850 Angstroms (A) to 2450 Angstroms, or it may be any other similar device having radiation detection sensitivity. A tubular shield 32 is concentrically aligned about radiation detector 30 and is characterized principally by being constructed of optically-opaque material. Tubular shield 32 may be made from material so as to form an optical shield about radiation detector 30. An internal light source 34 is positioned adjacent the outside surface of tubular shield 32, and is directed generally toward window 14. Light source 34 may be contained within a lamp housing 35, or may be otherwise attached to tubular shield 32. Light source 34 is characterized in that it is capable of generating radiant energy in the 1850 A - 2450 A frequency range. Lens cap 16 contains lens or window 14, and positions window 14 in abutting relationship adjacent the end of tubular shield 32.

Lens cap 16 has a circular groove 17 cut into its front face. Reflector ring 24 has a pair of ring clips 28, 29 attached thereto and projecting radially inwardly toward lens 14. Ring clips 28, 29 each have an ear 28*a*, 29*a*, adapted for a clamping fit against groove 17. Ring clips 28, 29 are aligned along an axis 3—3 which preferably is orthogonal to the axis of alignment 4—4 of cover 22. Ear 28*a* projects slightly over the edge of window 14, and is aligned with internal light source 34 as will be hereinafter described.

Figure 3:
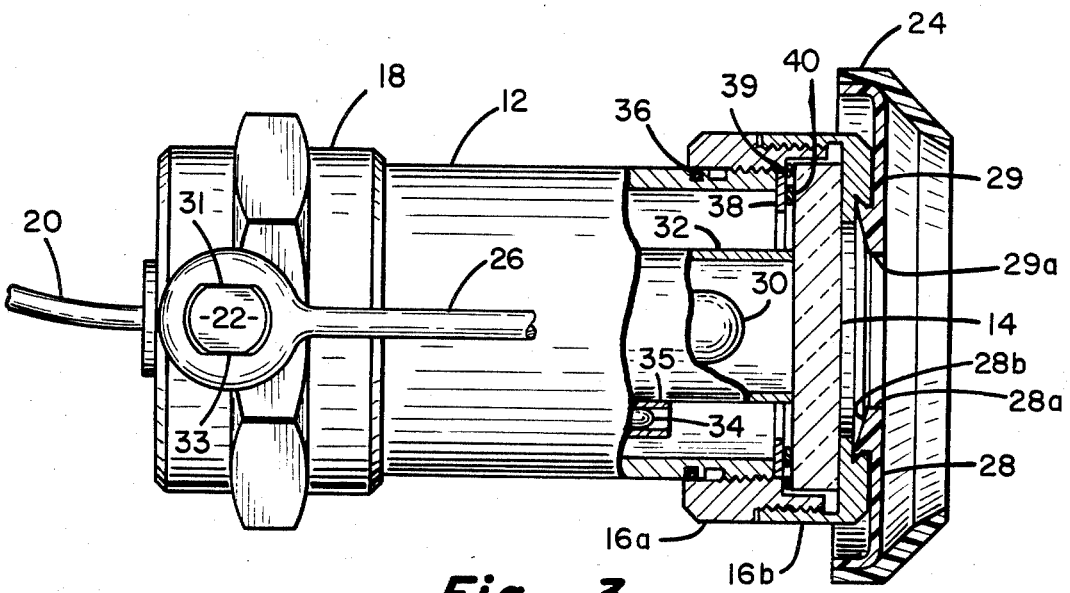
FIG. 3 shows a partial cross section view taken along the lines 3—3 of FIG. 2.

Referring next to FIG. 3, there is shown in partial cross section a view taken along the lines 3—3 of FIG. 2. Lens cap 16 is formed of two tubular sections 16*a* and 16*b*. Section 16*a* is threadably atttached to housing 12, and an O-ring 36 provides a seal therebetween. Section 16*b* is threadably attached to section 16*a* to compress a number of components tightly against the forward edge of housing 12. A ring 38 is tightly compressed immediately adjacent the front edge of housing 12. A pair of O-rings 39, 40 are compressed between ring 38 and window 14. O-rings 39, 40 may be replaced by a suitable gasket member having the necessary sealing and compression characteristics. The front surface of section 16*b* compresses window 14 inwardly toward housing 12, and is preferably threadably tightened to provide a secure seal between window 14 and the respective interior components. Window 14 is also compressed snugly against the forward edge of tubular shield 32 to provide an optical seal, and to thereby ensure that all radiation impinging upon radiation detector 30 must pass through window 14.

Ring clips 28 and 29 are attached to ring 24 by a suitable attachment mechanism. Ring clips 28 and 29 and ring 24 are preferably constructed of plastic material, and may therefore be molded as a single unit, or they may be molded into separate parts which are snapped together through appropriate locking grooves and tabs. Ring clips 28 and 29 each have an ear 28*a*, 29*a* projecting radially inwardly over at least a portion of window 14. Ear 28*a* has a curved inner surface 28*b* which is cut at an angle so as to reflect light from light source 34 to radiation detector 30. Surface 28*b* is preferably plated with a highly reflective plating material so as to form a mirrored surface. Ear 29*a* may have a similar surface. It should be noted that light source 34*a* passes outwardly through window 14, reflects against mirrored surface 28*b* back toward window 14, and passes through window 14 into the inner volume of tubular shield 32 to impinge upon radiation detector 30.

Figure 4:
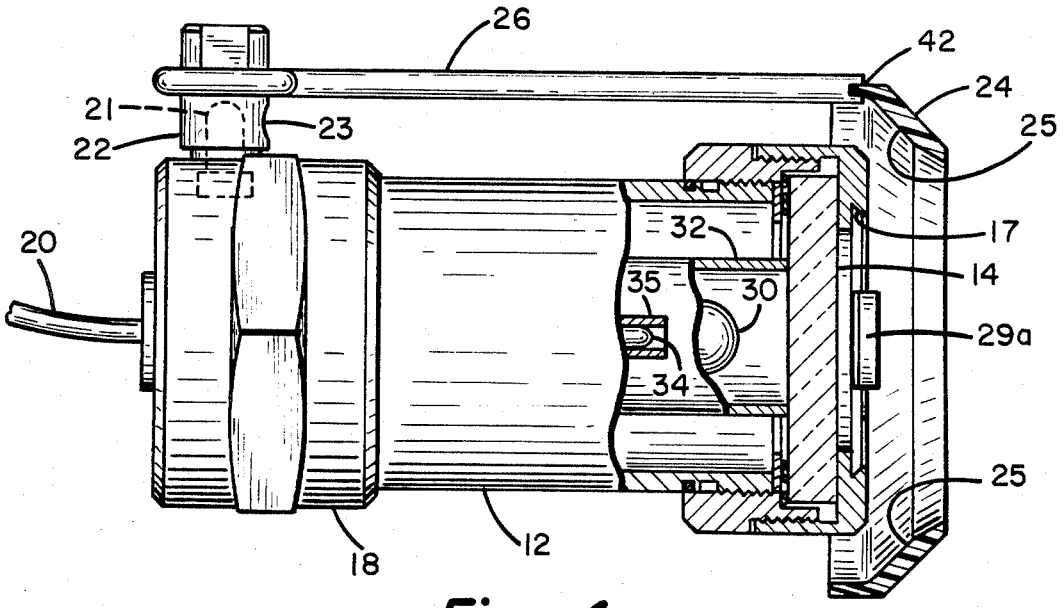
FIG. 4 shows a partial cross section view taken along the lines 4—4 of FIG. 2.

FIG. 4 shows a view taken along the lines 4—4 of FIG. 2, partially in cross section. Ring 24 is indexed by means of a suitable notch and groove 42, forming a connection between ring 24 and positioning bar 26. Positioning bar 26 is located about cover 22, each of which having mating flat surfaces 31, 33 to provide an indexing seat. Cover 22 has a forwardly-facing opening 23 to it's interior. A light source 21 is positioned inside cover 22, immediately adjacent opening 23 so as to permit light to escape therefrom. Ring 24 has an internal beveled surface 25 which surrounds window 14, and which is preferably plated with a metallic material so as to create a mirrored surface. Mirrored surface 25 receives light from light source 21 and reflects as least a portion of said light to window 14. Window 14 passes at least a portion of this light into the interior of tubular shield 32, to be received by radiation detector 30. The light transmission path from light source 21 to mirrored surface 25 passes through open air proximate the length of detector 10, and is thus affected by atmospheric conditions around detector 10. In the event smoke accumulates in the air around detector 10, the smoke will severely inhibit the light transmission path from light source 21 to radiation detector 30, resulting in a degradation of the electrical signal generated by detector 10 in response thereto.

In operation, detector 10 is typically placed in a hazardous environment having a high probability of generating flame or smoke. Detector 10 is usually positioned with window 14 facing the likely source of flame, and is connected to suitable electronic equipment capable of generating and receiving signals for operating detector 10. For example, radiation detector 30 is coupled through wires to amplifier circuits for amplifying and detecting electrical signals which are generated in response to the receipt of radiation by radiation detector 30. Internal light source 34 is coupled to siqnal generators for periodically illuminating light source 34, usually as a means for testing the optical path through window 14 as well as the radiation-receiving characteristics of radiation detector 30. Similarly, light source 21 is connected to suitable signal generation means for periodically generating light to be reflected by mirrored surface 25 back through window 14 for receipt by radiation detector 30. Circuits may be devised for comparing the respective signals received by radiation detector 30 from light transmitted from light source 34 by way of comparison with light transmitted from light source 21. In this manner, light source 34 may be used more or less as a base signal, as a point of comparison for measuring the relative degradation of the light signals received from light source 21, which degradation would principally be caused by smoke obscuring the light transmission path from light source 21. All of these signals are transmitted over wires contained within cable 20.

Respective light sources and light transmission paths may also be used to monitor the quality of maintenance of detector 10. For example, in the event the outer surface of window 14 becomes contaminated with dirt, vapors, or other opaque materials, radiation detector 10 will cease to function effectively. This contamination also affects the relative efficiency of transmission of light from both light sources 21 and 34, and may be detected by noting a reduction in signal strength received by radiation detector 30 from these sources. Similarly, if any of the mirrored surfaces described herein become contaminated by dirt, dust or other materials, this contamination may be monitored by means of monitoring the signal strength received from radiation detector 30. A significant reduction in any or all of the signals received by radiation detector 30 may be utilized as a maintenance warning to be generated by the electrical circuits connected thereto.

A further operational function is served by positioning bar 26 beyond that hereinbefore noted. In addition to serving as an indexing mechanism to provide the proper positioning for ring 24, positioning bar 26 also forms a protective arm to prevent the mounting of radiation detector 10 at a position so as to obscure the light transmission path between light source 21 and mirrored surface 25. Further, positioning bar 26 may be disconnected from contact with ring 24 to serve as a wrench for loosening cover 22 in the event light source 21 must be replaced.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for detecting smoke, vapor and flame, comprising (a) a tubular housing concentric about an axis, said housing having a closed rear end and an open front end, and a light transparent window covering said open front end;

(b) a radiation detection device aligned along said axis inside said housing, said device having a light sensitive element facing toward said window;

(c) a first light source affixed to said housing proximate said closed rear end, and an optical shield about said light source, said shield having a forwardly facing opening to permit light from said light source to pass external said housing and parallel to said axis; and (d) a circular ring concentric with said window and attached to said housing about said axis forward of said window, said ring having a beveled rear reflective surface inclined toward said window and facing generally toward said shield opening, to receive light from said first light source and to reflect same to said radiation detection device through said windows.

2. The apparatus of claim 1, further comprising an arm affixed between said first light source optical shield and said circular ring, farther from said axis than said shield opening.

3. The apparatus of claim 1 further comprising at least two radially inwardly directed clips attached to said light reflective ring, said clips extending toward said axis adjacent said window.

4. The apparatus of claim 3, further comprising a second light source in said housing, said second light source being positioned off-axis relative to said radiation detection device; and means for optically shielding said second light source from said radiation detection device in all directions except through said window.

5. The apparatus of claim 4, further comprising a mirrored surface external said housing and adjacent said window, said mirrored surface being positioned between said axis and said beveled rear reflective surface of said ring, for receiving light from said second light source and reflecting same to said radiation detector.

6. The apparatus of claim 5, wherein said mirrored surface further comprises a surface on at least one of said clips.

* * * * *